United States Patent [19]

de Nucheze et al.

[11] 4,249,484

[45] Feb. 10, 1981

[54] STEAM GENERATOR WITH AN INTEGRATED REHEATER FED WITH A LIQUID METAL

[75] Inventors: Louis de Nucheze, Paris; Marcel Robin, Sevres, both of France

[73] Assignee: Commissariat a l'Energie Atomique, Paris, France

[21] Appl. No.: 2,458

[22] Filed: Jan. 10, 1979

[30] Foreign Application Priority Data

Jan. 18, 1978 [FR] France ..... 78 01346

[51] Int. Cl.[3] ..... F22B 1/02

[52] U.S. Cl. ..... 122/32

[58] Field of Search ..... 122/32, 31 R, 477, 1 C

[56] References Cited

U.S. PATENT DOCUMENTS

| | | | |
|---|---|---|---|
| 3,854,528 | 12/1974 | Pouderoux et al. | 122/32 |
| 3,888,212 | 6/1975 | Wolowodiuk | 122/32 |
| 3,892,205 | 7/1975 | Naitou et al. | 122/32 |

*Primary Examiner*—Anthony V. Ciarlante

[57] ABSTRACT

The steam generator shell contains a bundle of straight tubes, the upper portion of which constitutes the superheat zone. A cylindrical jacket surrounds the upper portion of the shell and defines an annular reheat space containing helical tubes connected to a bottom steam inlet header and to a top outlet header. The reheat space communicates with the interior of the shell through a lower set of windows and through an upper set of windows provided with a cylindrical valve for regulating the rate of flow.

3 Claims, 3 Drawing Figures

STEAM GENERATOR WITH AN INTEGRATED REHEATER FED WITH A LIQUID METAL

This invention relates to a steam generator with integrated reheater fed with a liquid metal and especially liquid sodium.

In more exact terms, the present invention relates to a heat exchanger, the design function of which is to exchange heat between a liquid metal and water to be reheated and vaporized, the outer shell of the heat exchanger being so arranged as to form a region which serves to reheat the steam after expansion of this latter within high-pressure turbines for the purpose of reinjecting said reheated steam into the intermediate-pressure turbines.

It is known that, in fast nuclear reactors which are cooled by a liquid metal and especially by sodium or a sodium-potassium alloy, provision is made for a first sodium circuit or so-called primary circuit, for a second sodium circuit or so-called secondary circuit which exchanges heat on the one hand with the primary sodium circuit and on the other hand with a water circuit which feeds the turbines for the production of electric power. The present invention is concerned with the heat exchanger between the secondary sodium and the water.

Generally speaking, in an installation for the production of electric power, the steam which is expanded within the high-pressure turbine must be reheated before being fed to the inlet of the intermediate-pressure turbine. In the case of production of electric power from a liquid sodium cooled reactor, two different methods of reheating (resuperheating) can be contemplated: either reheating of the expanded steam by means of live steam or reheating of the steam by the hot sodium. The present invention is concerned with this second type of steam reheat system.

A better understanding of the different thermal circuits will be gained by referring to FIG. 1 of the accompanying drawings. This figure illustrates the circulation of the water and steam as well as the circulation of the sodium. The cold water first passes into an evaporator E, then into a superheater S; the superheated steam discharged from the outlet of the superheater is then introduced into the high-pressure turbine $T_1$. At the outlet of the turbine $T_1$, the partially cooled and expanded steam is fed back into the reheater R. After passing through the reheater, the steam penetrates into the intermediate-pressure turbine $T_2$, then into the low-pressure turbines. In regard to the sodium circuit, the flow path is as follows: the hot sodium fed from the reactor enters the reheater R and the superheater S in parallel, then passes into the economizer E and is finally recycled to the reactor.

The invention is primarily concerned with a steam generator provided with an internal reheater which is fed with sodium, said reheater being integrated in the shell of the steam generator.

A steam generator of the type comprising a reheater fed with sodium is already known. However, this type of generator is attended by many disadvantages. In particular, the tube coils which are provided in this heat exchanger for the circulation of water and which correspond respectively to the evaporator, to the superheater and to the reheater are superposed within the shell. This results in an appreciable complication of the means for supplying with water (or with steam) and with sodium.

Especially in the case of sodium, the steam generator must have a double distributor with devices for internal and external regulation. Moreover, said steam generator has an argon blanket above the sodium level, with all the disadvantages attached to this design concept. Finally, the superposition of the different bundles of tube coils and the presence of the above-mentioned argon blanket in the steam generator result in a very appreciable increase in the height of this latter in respect of a given power rating. This clearly results in a corresponding increase in cost of construction of the steam generator.

The precise aim of this invention is to provide a steam generator with integrated reheater fed with sodium which overcomes the disadvantages mentioned above by making provision for only one sodium feed circuit and a common water circuit for the evaporator and the superheater. Furthermore, the steam generator in accordance with the invention permits draining of the water-steam circulation tubes simply under the action of gravity by virtue of the presence of accessible bottom points in the heat-transfer tubes. It is known that this condition is laid down by many users of nuclear power plants.

In order to obtain these results, the invention relates to a steam generator having an integrated reheater fed with a liquid metal and comprising a shell of cylindrical shape. The distinctive feature of the steam generator lies in the fact that provision is made within the shell for a bundle of straight tubes fixed in a tube plate at each end, said tube plate being associated respectively with a bottom header for the introduction of water and with a top header for the discharge of steam, the upper portion of said tubes being intended to constitute the superheat zone and provision being made for a liquid metal discharge nozzle at the bottom of said shell. A cylindrical jacket surrounds the upper portion of said shell and defines an annular space (reheat zone) between said shell and said jacket, the top portion of said jacket being provided with a nozzle for the introduction of said liquid metal. Said annular space communicates with the interior of said shell through a first series of windows formed in said shell in the upper portion of said annular space and through a second series of windows formed in said jacket in the lower portion of said annular space. Said annular space contains a plurality of helical tubes connected to a bottom header for the admission of steam to be reheated and to a top header for the discharge of reheated steam. The above-mentioned windows of the first series are provided with means for regulating the rate of flow and for varying the extent of opening and with means for controlling said flow-regulating means. Temperature sensors placed within said annular space and within said shell immediately above the second series of windows are associated with means for comparing the measurements carried out by said sensors.

It is thus apparent that the steam generator is provided with only one header for the admission of liquid metal and that the distribution of liquid metal between the outer reheat zone and the inner superheat zone is so adjusted that the temperature of the liquid metal at the exit of these two zones has substantially the same value, taking into account the heat-transfer processes which take place within these two zones.

In accordance with a further distinctive feature, the generator is provided within said annular space with a horizontal plate pierced with orifices, said plate being placed on the one hand below the nozzle for the admission of liquid metal and the first series of windows and on the other hand above the tubes for discharge of reheated steam.

Preferably, the means for regulating the rate of flow consist of a circular valve having a diaphragm constituted by a cylindrical sleeve rotatably mounted on the steam generator shell and provided with a number of orifices corresponding to the number of windows of the first series, said orifices and said windows being intended to have the same dimensions and being capable of coinciding in respect of a given angular position of said cylindrical sleeve. Said flow-regulating means also comprise sealing means for ensuring leak-tightness between said sleeve and said shell, said sealing means being placed around each window of the first series.

A more complete understanding of the invention will in any case be obtained from the following description of one embodiment of the invention which is given by way of example and not in any limiting sense, reference being made to the accompanying drawings, wherein:

FIG. 1, described earlier, is a simplified diagram of the water-steam and sodium circuits corresponding to a steam generator and sodium-fed reheater;

Figure 2:
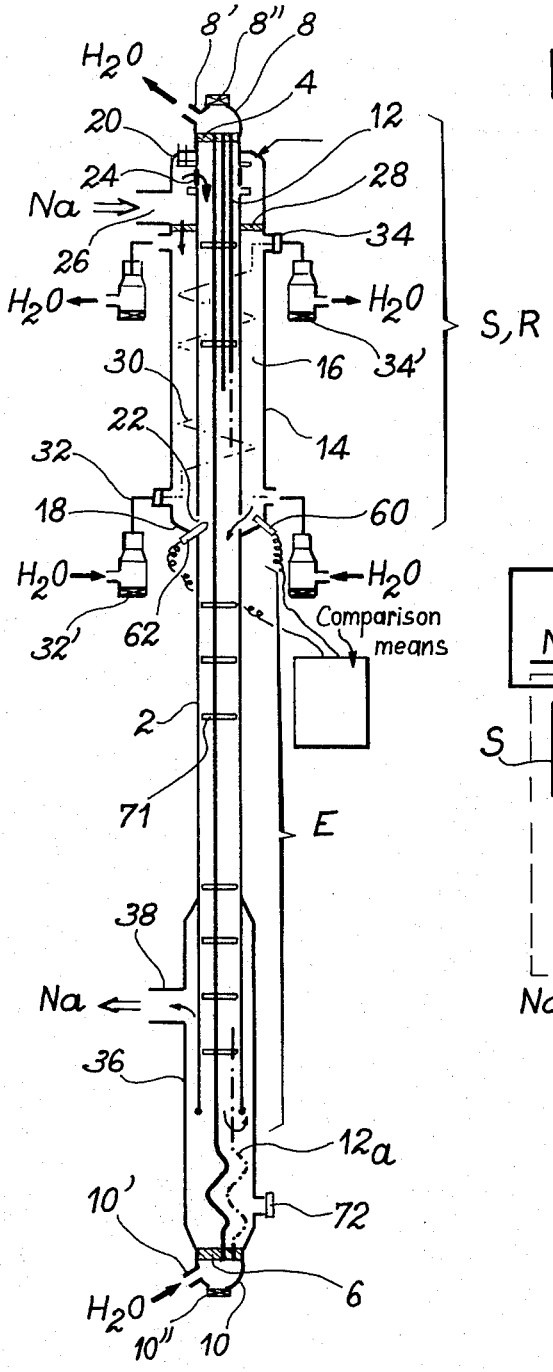
FIG. 2 is a simplified vertical sectional view of the complete steam generator unit in accordance with the invention.
Figure 1:
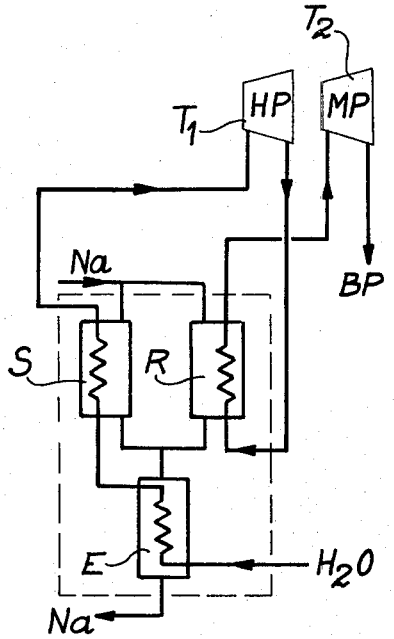

The steam generator in accordance with the invention comprises a vertical shell 2 of cylindrical shape which defines an internal passage and is provided at each end with a tube plate, namely a top tube plate 4 and a bottom tube plate 6. Said cylindrical shell 2 is completed by water-boxes 8 and 10 located beyond the tube plates. The bottom water-box 10 serves to introduce water to be heated through the nozzle 10' and to convert it to steam whilst the top water-box 8 serves to discharge superheated steam through the nozzle 8'. These water-boxes are provided with inspection holes 8'' and 10'' which are sealed-off by means of covers. Provision is made within the shell 2 for straight heat-transfer tubes such as the tube 12 which are fixed at each end in the tube plates 4 and 6 respectively. These tubes are employed for the circulation of water and steam. The lower ends of the tubes are provided with expansion bends 12*a* which serve to absorb thermal expansions without subjecting the tubes to unacceptable stresses. The straight tubes 12 define a lower region E which corresponds to the evaporator of the steam generator and an upper region S which corresponds to the superheater.

In the upper portion which corresponds precisely to the superheat zone, the shell 2 is surrounded by a cylindrical jacket 14 which forms an annular zone 16 between this latter and the shell 2. The cylindrical jacket 14 is joined to the shell 2 by means of domical ends 18 and 20. Windows such as the window 22 located in the lower portion of the shell serve to establish a communication between the annular space 16 and the interior of the shell 2. Similarly, windows 24 provide a communication between the interior of the shell 2 and the annular region 16 at the top portion of this latter. Preferably, the windows 22 have a large cross-sectional area for flow, on the one hand in order to reduce the sodium flow rate and on the other hand in order to facilitate product discharge to a safety diaphragm or bursting disc in the event of an accidental sodium-water reaction.

The provision is made at the upper end of the cylindrical jacket 14 for at least one hot sodium feed nozzle 26. Immediately beneath said nozzle 26, the annular space 16 is fitted with a horizontal sodium-distribution plate 28, the design function of which will hereinafter be explained in greater detail. Tube coils 30 which constitute the reheater R of the steam generator are mounted within the interior of said annular space 16 and beneath the distribution plate 28. Said tube coils are connected to steam reheat headers 32 and to reheated-steam headers 34. These headers are provided with inspection holes 32' and 34' which are sealed off by means of covers. At the lower end thereof, the shell 2 is surrounded by a second cylindrical jacket 36 constituting the sodium outlet. Said second cylindrical jacket surrounds the shell 2 over a fraction of its height and is provided with a sodium outlet nozzle 38.

The simplified operation of this steam generator is as follows: the cold water penetrates through the inlet nozzle 10' provided in the bottom water-box 10, passes through the straight tubes 12 and is discharged in the form of superheated steam through the nozzle 8' provided in the top water-box 8. The water thus passes successively within the bundle of straight tubes through the evaporation zone E and the superheat zone S. The sodium on the other hand follows a flow path in the opposite direction. The hot sodium fed from the reactor is admitted through the sodium inlet nozzle 26 and distributed (as will be explained in detail below) between the interior of the shell 2 and the annular space 16 by virtue of the distribution plate 28 and the windows 24. By virtue of the windows 22, the entire sodium flow is thus admitted into the bottom portion of the shell 2 (evaporator) and discharged through the nozzle 38. The steam to be reheated is admitted through the headers 32, follows the reheat coils 30 and the reheated steam is discharged through the headers 34.

Figure 3:
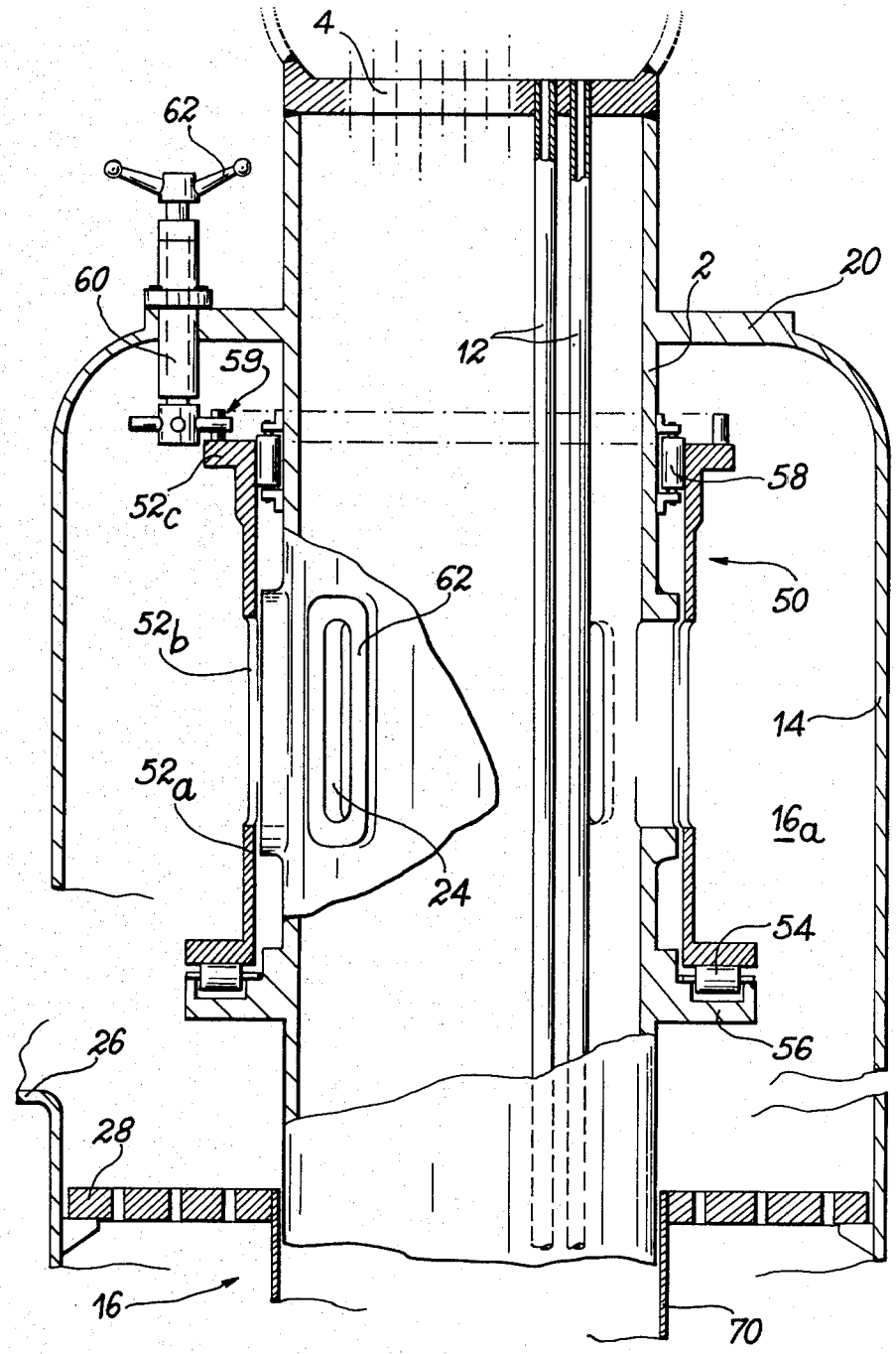
FIG. 3 is a detail view of FIG. 2 showing the upper portion of the steam generator and especially the device for distributing the sodium flow respectively within the superheater and within the reheater.

Referring now to FIG. 3, the method adopted for distributing the hot sodium between the superheat zone within the shell 2 and the reheat zone within the annular space 16 will now be described in greater detail. FIG. 3 shows the annular passage 16 and, more precisely, the upper portion 16*a* of said annular passage which is located above the distribution plate 28. The distribution of hot sodium between the reheat zone constituted by the annular space 16 and the superheat zone constituted by the space limited by the shell 2 is carried out on the one hand by means of the distribution plate 28 which produces the necessary pressure drop and ensures suitable sodium distribution within the reheater tube bundle and, on the other hand, by means of a valve designated by the general reference 50 and having a cylindrical diaphragm which is rotatably mounted on the shell 2 and capable of obturating to a greater or lesser extent the windows 24 formed in the shell 2. Said cylindrical-diaphragm valve 50 is constituted by a cylindrical sleeve 52*a* pierced by openings 52*b* which coincide with the windows 24 in respect of a particular position of the sleeve. Said sleeve 52*a* is supported for rotational motion by means of rollers 54 mounted on the ring 56 which is rigidly fixed to the shell 2. Said sleeve is also guided in rotational motion by rollers 58 having vertical axes and mounted on the shell 2. Moreover, said cylindrical sleeve has a top annular flange 52*c* which is provided with studs 59 and is thus capable of cooperating with a mechanism 60 for driving the sleeve 52*a* in rotation. It can readily be understood that rotation of the sleeve can be effected by other known means. For example, the annular flange 52c can be provided with a circular toothed rack disposed in meshing engagement with a driving pinion fixed at the lower end of the actuating mechanism 60. Each window 24 is fitted with a seal 62 for providing a semi-leaktight joint between the shell 2 and the solid portion of the cylindrical sleeve 52a. It is apparent that, by producing action on the mechanism 60, the cylindrical sleeve 52a is caused to rotate about the vertical axis of the steam generator, thus making it possible to adapt the cross-sectional area provided for the flow of sodium to the interior of the shell 2 by adjusting the common portion between the windows 24 and 52b.

The design function of the distribution plate 28 is to produce a very substantial pressure drop for the sodium which is necessary for steam reheat and which passes from the space 16a to the annular space 16 containing the reheater tube bundle. Thus a substantial fraction of the sodium flow arrives at the openings 52b of the valve 50.

The flow of sodium within the shell 2 is regulated by the valve 50 in such a manner as to ensure that the sodium from the superheater and the sodium from the reheater are substantially at the same temperature at the level of the openings 22 before the sodium penetrates into the evaporator zone E. This arrangement makes it possible to minimize heat-transfer surfaces. A further advantage of this arrangement lies in the fact that it dispenses with the need to mix sodium flows at different temperatures, which is always a difficult operation by reason of the thermal stresses which arise within the mixer. In order to ensure this equality of temperatures at the outlet of the superheater and of the reheater, temperature sensors 60 and 62 are placed respectively at the outlet of the superheater and of the reheater. Said sensors provide a continuous measurement of these temperatures and serve to calculate the difference between them. By means of the mechanical system 60 which is controlled by the operating handle 63, the opening of the valve 50 is so adjusted as to ensure that the rates of sodium flow within the superheater and the reheater ensure the desired equality of temperatures. It is readily apparent that the mechanical system 60 could be controlled by means of an electric motor supplied with a current which is representative of the difference between temperatures. It would be possible to employ a servomechanism of conventional type for continuously ensuring equality of temperatures.

Experiments performed on a prototype reactor have shown that it was only necessary in some cases to adjust the flow rates to nominal conditions of operation of the heat exchanger in order to obtain equality of temperatures at the superheater and reheater outlets whilst the flow distribution remains correct in respect of partial loads, thus making it possible to simplify the servomechanism which is contemplated.

As can more clearly be seen in FIG. 3, a second cylindrical shell 70 serves to duplicate the shell 2 in this zone. This outer shell permits the attachment of spacers for the reheater tube coils 30, with the result that the reheater can be constructed in one piece and subsequently mounted as a single unit. Moreover, this double wall serves to prevent a substantial heat flux between the two parallel streams of sodium, thus facilitating adjustment to flow rates as a function of the outlet temperatures of these two streams.

It should be added that the shell 2 is provided with spacer grids 71 for bracing the tubes 12 within said shell in accordance with known practice and that the heat exchanger can advantageously be fitted with thermal shields for protecting the tube plates. Moreover, the cylindrical jacket 36 can be fitted with a safety diaphragm or bursting disc 72 in the event of accidental overpressure.

By way of alternative, the outlet nozzle 38 can be mounted directly within the shell 2 and immediately above the tube plate 6. The cylindrical jacket 36 is clearly dispensed with in this case, thus making it possible to increase the useful length of the heat-transfer tubes 12.

It is apparent from the foregoing description that the steam generator in accordance with the invention fully satisfies the requirements indicated in the introduction. There is only one sodium feed circuit for the entire assembly consisting of steam generator and reheater. Furthermore, the evaporator and superheater are constituted by the same bundle of heat-transfer tubes. The result thereby achieved is on the one hand to reduce the overall size of the steam-generating unit and on the other hand to circumvent the awkward problem of connection of a number of tube bundles.

A further advantage of the invention lies in the arrangement of the reheater, the superheater and the evaporator. This makes it possible in the first place to supply the superheater and the reheater by means of a single sodium feed pipe, therefore at the maximum reactor outlet temperature which is conductive to optimum thermodynamic efficiency. In the second place, the sodium streams discharged from the reheater and from the superheater are fed directly to the evaporator inlet without any intermediate piping.

This arrangement is very economical and highly reliable. In addition, it only calls for the use of a single regulating valve without any need to provide the valve-operating stem with a leak-tight passage through the end wall 20. We claim:

1. A steam generator having an integrated reheater fed with a liquid metal and comprising a shell of cylindrical shape, wherein provision is made within the shell of said generator for a bundle of straight tubes fixed in a tube plate at each end, said tube plate being associated respectively with a bottom water inlet header and with a top steam outlet header, a liquid metal outlet nozzle provided in the lower portion of said shell, a jacket which surrounds the upper portion of said shell and defines an annular space between said jacket and said shell, the top portion of said jacket being provided with a nozzle for the introduction of said liquid metal into said heat exchanger at the top portion of said annular space, said annular space communicating with the interior of said shell through a first series of windows formed in said shell in the upper portion of said annular space and through a second series of windows formed in said jacket in the lower portion of said annular space, said annular space containing a plurality of helical tubes connected to a bottom header for the admission of steam to be reheated and to a top header for the discharge of reheated steam, said windows of the first series being provided with means for regulating the rate of flow and for varying the extent of opening and with means for controlling said flow-regulating means and adjusting the flow distribution of sodium which circulates within said annular space and the flow of sodium which penetrates into said shell through the windows of the first series, and temperature sensors placed within said annular space and within said shell immediately above the second series of windows, said sensors being connected with means for comparing the measurements carried out by said sensors.

2. A steam generator according to claim 1, wherein said generator is provided within said annular space with a horizontal plate pierced with orifices, said plate being placed below the liquid metal inlet nozzle, below the first series of windows and above the reheated water outlet header.

3. A steam generator according to claim 1, wherein said means for regulating the flow rate consist of a circular valve having a diaphragm constituted by a cylindrical sleeve rotatably mounted on the steam generator shell and provided with a number of orifices corresponding to the number of windows of the first series, said orifices and said windows having the same dimensions and being capable of coinciding in respect of a given angular position of said cylindrical sleeve, and of sealing means for ensuring leak-tightness between said sleeve and said shell, said sealing means being placed around each window of the first series.

* * * * *